US005787320A

United States Patent [19]

Eun et al.

[11] Patent Number: 5,787,320

[45] Date of Patent: Jul. 28, 1998

[54] TONER DENSITY ADJUSTING METHOD FOR AN IMAGE RECORDING APPARATUS

[75] Inventors: Jong-Moon Eun, Suwon; Yoon-Tae Lee, Kwongsun-gu, both of Rep. of Korea

[73] Assignee: SamSung Electronics Co., Ltd., Kyungki-do, Rep. of Korea

[21] Appl. No.: 695,605

[22] Filed: Aug. 12, 1996

[30] Foreign Application Priority Data

Aug. 12, 1995 [KR] Rep. of Korea ..... 1995 24909

[51] Int. Cl.[6] ..... G03G 15/10; G03G 15/08

[52] U.S. Cl. ..... 399/59; 399/27; 399/260

[58] Field of Search ..... 399/27, 45, 49, 399/58, 59, 258, 259, 260

[56] References Cited

U.S. PATENT DOCUMENTS

| | | | |
|---|---|---|---|
| 4,974,024 | 11/1990 | Bares et al. | 399/58 |
| 5,160,966 | 11/1992 | Shiina et al. | 399/27 |
| 5,214,476 | 5/1993 | Nomura et al. . | |
| 5,310,425 | 5/1994 | Nakagawa et al. . | |
| 5,353,103 | 10/1994 | Okamoto et al. . | |
| 5,365,319 | 11/1994 | Sakemi et al. . | |
| 5,450,177 | 9/1995 | Oyama . | |
| 5,475,476 | 12/1995 | Murai et al. . | |
| 5,483,328 | 1/1996 | Kawasaki et al. . | |
| 5,504,557 | 4/1996 | Morita . | |
| 5,508,793 | 4/1996 | Kimura et al. . | |
| 5,559,579 | 9/1996 | Gwaltney et al. | 399/49 X |

FOREIGN PATENT DOCUMENTS

| | | |
|---|---|---|
| 01-115649 | 5/1989 | Japan . |
| 04-348370 | 12/1992 | Japan . |

*Primary Examiner*—Shuk Lee
*Attorney, Agent, or Firm*—Robert E. Bushnell, Esq.

[57] ABSTRACT

A method for adjusting toner density is provided for an image recording apparatus which stores a weighted value table having weighted values corresponding to toner consumption coefficients and a driving table having driving times of a toner supply motor corresponding to the weighted values. The method is carried out by calculating a toner consumption coefficient for each line of a page. This is performed by dividing a number of black data bits represented on each line by a total number of data bits represented on each line. Weighted values corresponding to the calculated toner consumption coefficients are then obtained from the weighted value table. From these weighted values, an average weighted value for the page is generated. The driving table is then searched to locate a driving time corresponding to the average weighted value. The toner supply motor is driven in accordance with the driving time to thereby adjust the toner density while printing the page.

15 Claims, 7 Drawing Sheets

D0
D1727 t1 t2
D0 D1 D2 D3 D4 D5 D6 D7 D8 D9 D10 D11

TONER DENSITY ADJUSTING METHOD FOR AN IMAGE RECORDING APPARATUS

CROSS-REFERENCE TO RELATED APPLICATIONS

This application makes reference to, incorporates the same herein, and claims all benefits accruing under 35 U.S.C. §119 arising from an application for Toner Density Adjusting Method For An Image Recording Apparatus earlier filed in the Korean Industrial Property Office on 12 Aug. 1995 and there duly assigned Ser. No. 24909/1995.

BACKGROUND OF THE INVENTION

The present invention relates to a method for adjusting toner density in an image recording apparatus, and more particularly, to a method for adjusting toner density in an image recording apparatus utilizing a two-component developing system.

Currently, an electrophotographic development system is utilized in image recording apparatuses, such as laser printers, printers employing an LED print head (hereinafter referred to as "LPH") and plain paper (PP) facsimiles.

In image recording apparatuses utilizing the electrophotographic development system, the development system for applying toner to an electrostatic latent image formed on a photoconductive member can be a single component developing system, which uses only toner, or a two-component developing system, which uses a mixture of toner and a carrier as a developing material. In order to record a high quality image with a two-component developing system, the adjustment of toner density is an important task, as compared to a single component developing system. Since the single component developing system utilizes only toner, the existence of the toner is detected to adjust the amount of the toner. With the two-component developing system, however, toner density must be accurately detected to consistently adjust the weight ratio of toner to carrier.

One prior art reference that utilizes a two-component developing system is U.S. Pat. No. 5,365,319 entitled Image Forming Apparatus Replenishing Toner By Detecting The Ratio Of Toner And Carrier And The Density Of The Developer issued to Sakemi et al. In Sakemi et al. '319, a first sensor is provided for detecting information corresponding to toner density of a two-component developer including toner and carrier particles, and a second sensor is provided for detecting information corresponding to the density of the two-component developer. The outputs of the two sensors are provided to two analog-to-digital (A/D) converters which provide their respective outputs to a central processing unit (CPU). An amount of toner to be replenished to the two-component developer is then controlled on the basis of the outputs of the two sensors. While this type of prior art possesses merit in its own right, we note that it employs sensors and analog-to-digital (A/D) converters that significantly increase the overall cost of the image recording apparatus.

SUMMARY OF THE INVENTION

Accordingly, it is an object of the present invention to provide a method for adjusting toner density in an image recording apparatus by accurately detecting toner density without using a toner sensor and an analog-to-digital (A/D) converter.

It is another object to provide a method for adjusting toner density in an image recording apparatus by monitoring the state of image data to calculate a toner consumption amount, and maintaining consistent toner density based on the toner consumption amount.

It is still another object to provide a method for calculating a total toner consumption amount to maintain the durable life of an image recording apparatus which accumulatively stores the number of printed pages and toner consumption coefficients.

It is yet another object to provide an image recording apparatus that utilizes a two-component developing system and can be produced for a reduced cost.

To achieve these and other objects, the present invention provides a method for adjusting toner density in an image recording apparatus which stores a weighted value table for providing weighted values corresponding to toner consumption coefficients and a driving table for providing driving times of a toner supply motor corresponding to the weighted values. The method is carried out by calculating a toner consumption coefficient for each line of a page. This is performed by dividing a number of black data bits represented on each line by a total number of data bits represented on each line. Weighted values corresponding to the calculated toner consumption coefficients are then obtained from the weighted value table. From these weighted values, an average weighted value for the page is generated. The driving table is then searched to locate a driving time corresponding to the average weighted value. The toner supply motor is driven in accordance with the driving time to thereby adjust the toner density while printing the page.

BRIEF DESCRIPTION OF THE DRAWINGS

The above objects and other advantages of the present invention will become more apparent by describing in detail preferred embodiments thereof with reference to the attached drawings in which.

DETAILED DESCRIPTION OF THE PREFERRED EMBODIMENTS

Figure 1:
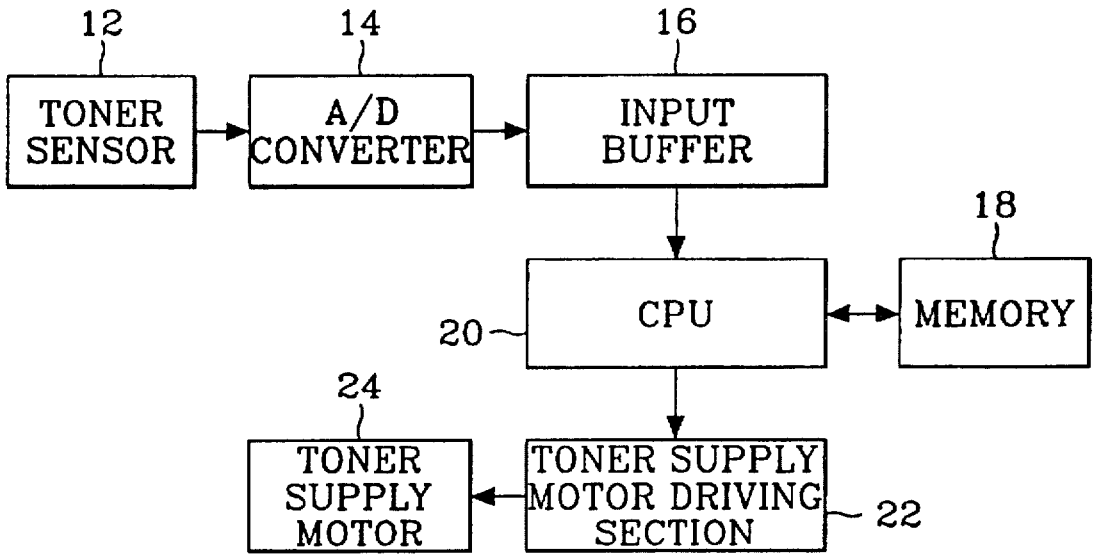
FIG. 1 is a block diagram of a circuit for adjusting the toner supply in an electrophotographic image recording apparatus.
Figure 2:
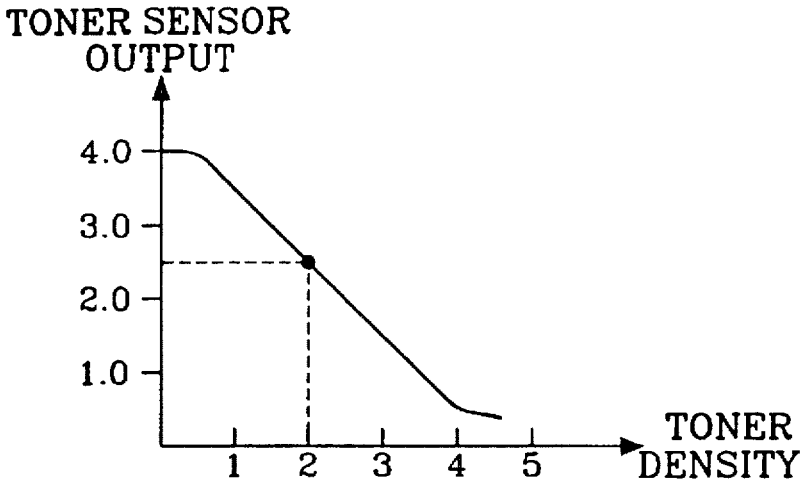
FIG. 2 is a graph showing the relationship between the output of a toner sensor and toner density in an electrophotographic image recording apparatus.

Turning now to the drawings and referring to FIG. 1, a block diagram of a circuit for adjusting the toner supply in an electrophotographic image recording apparatus is shown. FIG. 2 is a graph showing the relationship between the output of a toner sensor and toner density in an electrophotographic image recording apparatus.

The operation for detecting toner density, and adjusting the supply of toner in accordance with the detected toner density will be described with reference to FIGS. 1 and 2. A photoconductive drum in the image recording apparatus is a photoconductive object for forming an electrostatic latent image, and a developing unit contains a developing material composed of a carrier mixed with toner supplied from a toner hopper. The quality of a recorded image is determined by the mixing ratio of the developing material. The toner within the toner hopper is supplied to the developing unit by the rotation of a roller performed in accordance with the driving of a toner supply motor 24. Toner supply motor 24 is driven by a toner supply motor driving section 22 that is controlled by a central processing unit (hereinafter referred to as "CPU") 20. The developing material within the developing unit is applied onto the photoconductive drum by a developing roller. The mixing ratio of the toner and carrier within the developing unit is sensed by a toner sensor 12. An analog signal output from toner sensor 12 as a result of this sensing is digitized in an analog-to-digital (A/D) converter 14 to generate digital data which is supplied to CPU 20 via an input buffer 16. CPU 20 compares the mixing ratio represented by the digital data with a preset reference mixing ratio stored in a memory 18, and controls toner supply motor driving section 22 in accordance with the result of the comparison. Therefore, the mixing ratio of developing material within the developing unit is consistently maintained through periodic adjustments.

In a two-component developing system as represented by FIG. 1, one of the most difficult challenges is to adjust the toner density in which the toner is frictionally charged with electricity, to consistently maintain the weight ratio of toner and carrier. Here, $$\text{toner density } (\%)=[(\text{toner weight})/(\text{toner weight}+\text{carrier weight})]\times 100.$$

In order to adjust the toner density to maintain of a constant toner density, the toner sensor 12 for sensing the weight ratio of the toner and carrier, and the A/D converter 14 for converting the output value of toner sensor 12 into digital data must be separately employed. Due to this construction, the overall cost of the image recording apparatus is increased. Moreover, if the number of quantization steps of A/D converter 14 is small in the above-described image recording apparatus, the toner density cannot be accurately detected and a high-definition A/D converter of 8 bits or higher should be utilized. Also, the deviation occurring in both toner sensor 12 and A/D converter 14 causes a problem of having to add a process for regulating toner sensor 12 (i.e., sensitivity control) to the manufacturing line.

Figure 3:
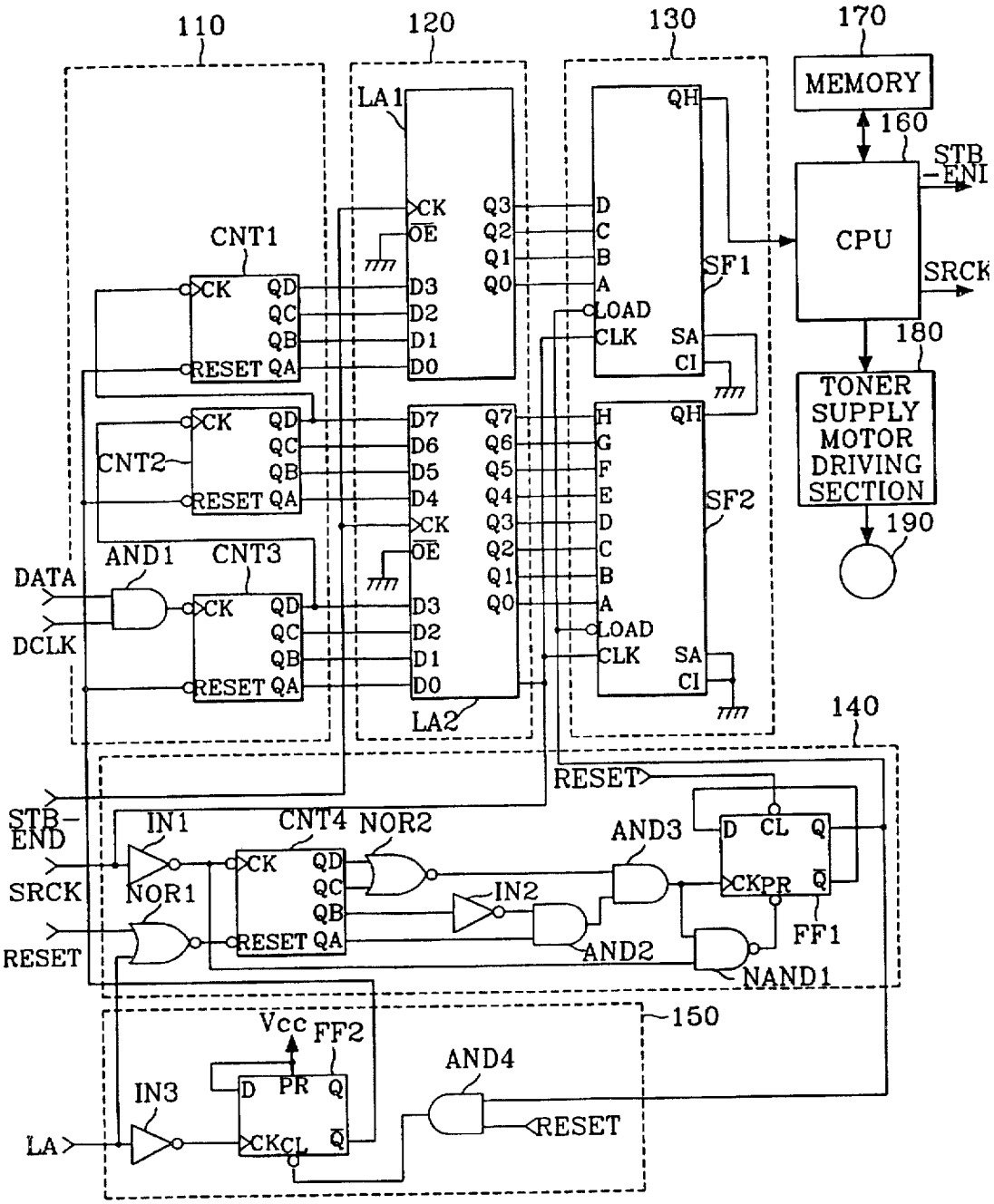
FIG. 3 is a diagram of a circuit for adjusting the toner density in an electrophotographic image recording apparatus constructed according to the principles of the present invention.

FIG. 3 is a diagram of a circuit for adjusting the toner density in an electrophotographic image recording apparatus constructed according to the principles of the present invention. The electrophotographic image recording system utilizing the circuit shown in FIG. 3 includes a latent image forming unit (not shown) for forming a latent image on a photoconductive drum in a constant block unit per line according to image data DATA, and a developing unit (not shown) for developing the formed latent image by means of developing material obtained by mixing toner and carrier. In addition to these elements, the image recording apparatus includes a toner supply motor driving section 180 which drives a toner supply motor 190 to supply the toner to the developing unit, and a memory 170.

The image recording apparatus of FIG. 3 further includes a recorded data counting section 110 for counting the number of recorded data bits included in one line of image data DATA, in synchronization with a data transmission clock signal DCLK, for transmitting image data DATA to the latent image forming unit.

A counted data latch section 120 latches the counted data in parallel for each line by means of a strobe end signal STB-END with respect to the latent image formation in the block unit of the latent image forming unit.

A counted data transmission section 130 loads the latched parallel counted data under a predetermined control, and shifts the loaded data by means of a transmission request clock signal SRCK, which requests transmission of the counted data in order to convert and serially transmit the data.

A counted data transmission control section 140 loads the latched parallel counted data upon counted data transmitting section 130 in response to transmission request clock signal SRCK.

A counted data reset section 150 resets the recorded data counting section 110 at the starting point of every line and at every loading point of the counted data by means of a line sync signal LA of image data DATA, and the load control of counted data transmission control section 140.

A CPU 160 generates a strobe end signal STR-END and provides the same to counted data latch section 120 for each line of data, and generates transmission request clock signal SRCK for transmission to counted data transmission control section 140. CPU 160 also receives counted data for storage in memory 170, determines the amount of toner that is consumed from the stored counted data, and accordingly adjusts the supply of toner by controlling toner supply motor driving section 180.

Among the elements shown in FIG. 3, recorded data counting section 110 is comprised of one AND gate AND1 and three counters CNT1~CNT3, and counted data latch section 120 is comprised of two latch circuits LA1 and LA2. Counted data transmitting section 130 is comprised of two parallel-to-serial shift registers SF1 and SF2, and counted data transmission control section 140 is comprised of two inverters IN1 and IN2, two NOR gates NOR1 and NOR2, one counter CNT4, two AND gates AND2 and AND3, one NAND gate NAND1 and one flip-flop FF1. Counted data reset section 150 is comprised of one inverter IN3, one AND gate AND4 and one flip-flop FF2. In addition, the latent image forming unit is provided internally for forming the latent image in accordance with image data DATA. Toner supply motor driving section 180 and toner supply motor 190 are responsible for supplying toner, and are the same as toner supply motor driving section 22 and toner supply motor 24 described with reference to FIG. 1.

Figures 4A, 4B, 4C, 4D, 4E, 4F, 4G, 4H, 4I:
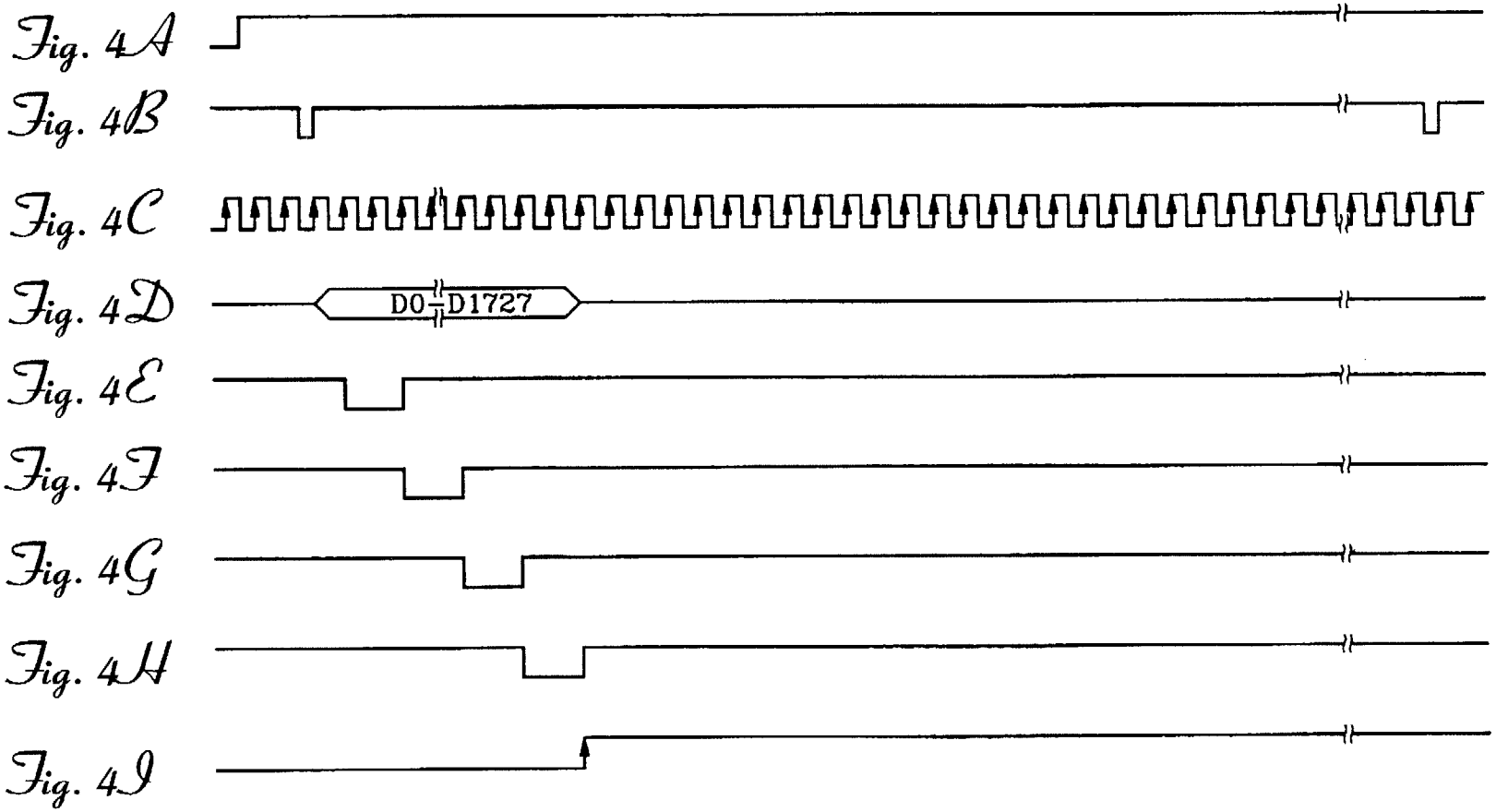
FIGS. 4A through 4R are operational waveforms of the circuit sections shown in FIG. 3.
Figures 4J, 4K, 4L, 4M, 4N, 4O, 4P, 4Q, 4R:
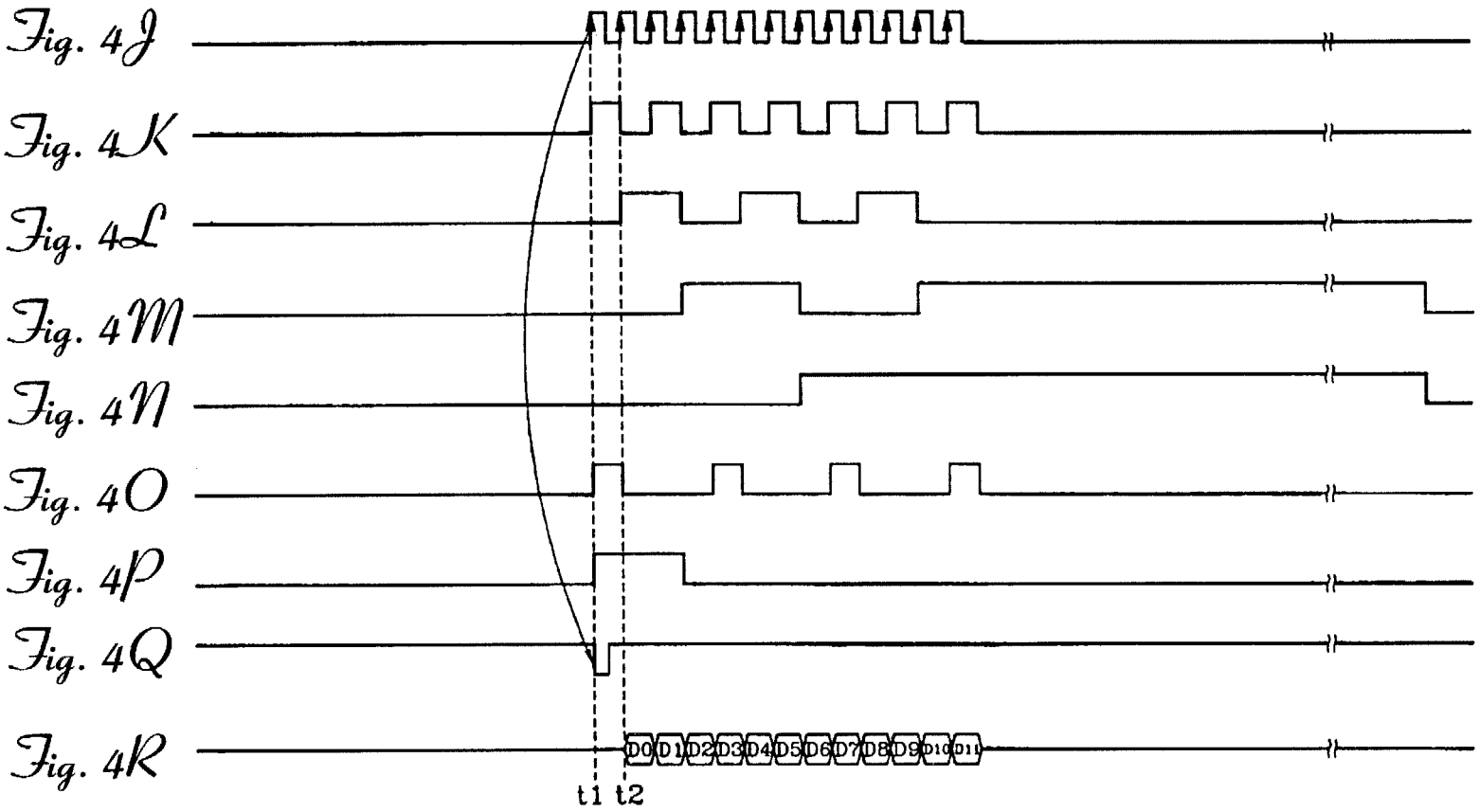

FIGS. 4A through 4R are operational waveforms of the sections shown in FIG. 3.

The operation of the circuit for adjusting the toner density in an electrophotographic image recording apparatus shown in FIG. 3 will now be described in detail with reference to the operational waveforms of FIGS. 4A through 4R.

First, the present invention does not separately employ a toner sensor. Rather, the number of bits of image data per line that consume toner (i.e., the number of bits of black data in image data DATA) is counted to determine the amount of toner to be consumed in accordance with a statistical method, thereby controlling the supply of toner to the developing unit.

In the following description, one can assume that the circuit of FIG. 3 is applied to a laser beam printer, and that a latent image corresponding to image data DATA is formed on the photoconductive drum of the printer in four block units per line.

The circuit shown in FIG. 3 is reset by a reset signal RESET shown in FIG. 4A that is generated by the image recording apparatus during an initial stage. Then, after counters CNT1~CNT3 of recorded data counting section 110 are reset by an output provided from counted data reset section 150 in response to line sync signal LA shown in FIG. 4B, data transmission clock signal DCLK shown in FIG. 4C and image data DATA shown in FIG. 4D are synchronized by AND gate AND1 to begin counting the number of bits of recorded data included in image data DATA. Data transmission clock signal DCLK is a clock signal for serially transmitting image data DATA to the LPH of the image recording apparatus.

The counting capacity of counters CNT1~CNT3 is determined by the size of a recording sheet. In the present invention, the counters constitute a $2^{11}$ binary counting device to enable counting of 1728 pixels, which is the maximum number of pixels per line when the recording sheet is of A4 size. Also, line sync signal LA is a signal for latching image data DATA of one line to the latent image forming unit. For a laser beam printer, line sync signal LA may have a period of 5 milliseconds, 10 milliseconds, or the like, in accordance with the particular laser beam printer.

The latent image forming unit forms the latent image by four strobe signals shown in FIGS. 4E to 4H. CPU 160 generates strobe end signal STB-END shown in FIG. 4I upon the completion of the strobe signals. Then, latch circuits LA1 and LA2 of counted data latch section 120 latch the data generated by recorded data counting section 110 as a result of counting the recorded data is included in one line of image data DATA, in response to the strobe end signal STB-END.

In the above-described state, when transmission request clock signal SRCK shown in FIG. 4J is generated from CPU 160 at a point t1, counter CNT4 of counted data transmission control section 140 operates upon transmission request clock signal SRCK to provide signals shown in FIGS. 4K to 4N via output terminals QA~QD. By doing so, an output signal from NOR gate NOR2 is generated as shown in FIG. 4O, and an output signal from AND gate AND2 is generated as shown in FIG. 4P. Therefore, a logic "low" signal, as shown in FIG. 4Q, is produced from a non-inverting output terminal Q of flip-flop FF1 by the first pulse of transmission request clock signal SRCK, and is supplied to a load terminal LOAD of parallel-to-serial shift registers SF1 and SF2 of counted data transmission section 130.

By this operation, parallel-to-serial shift registers SF1 and SF2 load the counted data latched to latch circuits LA1 and LA2, and then shift from the second pulse of transmission request clock signal SRCK to convert and output the result as serial data, as shown in FIG. 4R.

Consequently, CPU 160 receives the counted data of one word from an output terminal QH of parallel/serial shift register SF1, and stores it in memory 170. In addition, CPU 160 determines the toner density from the amount of toner consumed with respect to the preset number of recorded data bits corresponding to the counted data stored in memory 170. As a result, CPU 160 controls the toner supply of toner supply motor driving section 180, thereby consistently maintaining the density of the toner.

In performing the present invention, Tables 1 through 3 as follows are utilized to provide data that enables consistent maintenance of toner density.

<TABLE 1>

| | | | | | | | | | |
|---|---|---|---|---|---|---|---|---|---|
| Toner Consumption Coefficient | 0% (White Paper) | 1–5% | 6–10% | 11–15% | 16–20% | 21–25% | 26–30% | 31–35% | 36–40% |
| Weighted Value | 0 | 1 | 2 | 3 | 4 | 5 | 6 | 7 | 8 |
| Toner Consumption Coefficient | 41–45% | 46–50% | 51–55% | 56–60% | 61–65% | 66–70% | 71–75% | 76–80% | 81–85% |
| Weighted Value | 9 | A | B | C | D | F | F | 10 | 11 |
| Toner Consumption Coefficient | 86–90% | 91–95% | 96–100% | — | Toner consumption coefficient (%)→ (number of black data bits in one line)/(total number of data bits in one line) × 100 | | | | |
| Weighted Value | 12 | 13 | 14 | — | * Weighted value is designated by hexadecimal notation. | | | | |

<TABLE 2>

| -using one sheet as a reference- | | | | | | | | | |
|---|---|---|---|---|---|---|---|---|---|
| Toner Consumption Coefficient | 0% | ~5% | ~10% | ~15% | ~20% | ~25% | ~30% | ~35% | ~40% |
| Amount of Toner Consumed | 0 mg | 20 mg | 30 mg | 45 mg | 60 mg | 75 mg | 90 mg | 115 mg | 120 mg |
| Toner Consumption Coefficient | ~45% | ~50% | ~55% | ~60% | ~65% | ~70% | ~75% | ~80% | ~85% |
| Amount of Toner Consumed | 135 mg | 150 mg | 165 mg | 180 mg | 200 mg | 230 mg | 235 mg | 240 mg | 255 mg |
| Toner Consumption Coefficient | ~90% | ~95% | ~100% | * Consumption amount for one page as a reference * Amount of toner consumed is set by respective measured values per page | | | | | |
| Amount of Toner Consumed | 270 mg | 285 mg | 300 mg | * Actual amount of toner consumed may differ according to characteristics of developing unit | | | | | |

<TABLE 3>

(Units: motor driving time = msec, toner supply amount = mg)

| | | | | | | | | | |
|---|---|---|---|---|---|---|---|---|---|
| Weighted Value | 1 | 2 | 3 | 4 | 5 | 6 | 7 | 8 | 9 |
| Toner Supply Motor Driving Time | 666.66 | 1000 | 1500 | 2000 | 2500 | 3000 | 3833.33 | 4000 | 4500 |
| Amount of Toner Consumed | 20 | 30 | 45 | 60 | 75 | 90 | 115 | 120 | 135 |
| Weighted Value | A | B | C | D | E | F | 10 | 11 | 12 |
| Toner Supply Motor Driving Time | 5000 | 5500 | 6000 | 6666.66 | 7666.66 | 7833.33 | 8000 | 8500 | 9000 |
| Amount of Toner Consumed | 150 | 165 | 180 | 200 | 230 | 235 | 240 | 255 | 270 |
| Weighted Value | 13 | 14 | * Divide by 20 steps from white paper to 100% black image data to obtain weighted value each step and make table. | | | | | | |
| Toner Supply Motor Driving Time | 9500 | 10000 | * Locate toner amount according to respective weighted values to determine time required in driving motor for supplying that amount of toner. | | | | | | |
| Amount of Toner Consumed | 285 | 300 | * Toner supply motor driving time is uniformly distributed in accordance with the corresponding weighted value for a print period of a page. | | | | | | |

As shown in the tables, the percentage of image data per page that is actually represented with toner is defined by the toner consumption coefficient, and the amount of toner consumed in correspondence with particular toner consumption coefficients is experimentally obtained. Also, the amount of toner consumed is weighted to generate the tables. In Table 1, the weighted values are designated in hexadecimal notation. The toner supply motor driving times corresponding to the weighted values are determined so that the toner supply times correspond to the amount of toner that is consumed, as illustrated in Table 3. In Table 3, the percentages of black data are represented from 0% to 100% in 20 steps, which are respectively weighted per step to generate the table. In addition, the motor driving time is determined for supplying the corresponding toner supply in consideration of the amount of toner consumed in accordance with respective weighted values. In Table 3, the toner supply amount per unit of time is set as 0.03 mg/msec. Table 2 illustrates information obtained by calculating the toner consumption coefficient and weighted value per one line in Table 1 by pages. That is, the toner consumption coefficient per page corresponding to the average weighted value is obtained, and the amount of toner consumed is calculated using the page as a reference. Therefore, the average weighted value is obtained as follows. Average weighted value=(sum of the weighted values obtained from black image data in each line)/(number of total lines in one page). Also, the average toner consumption amount is the sum of the toner consumption amounts from each of the lines on a single page. Tables 1 through 3 as illustrated above are stored in memory 170.

Figure 5:
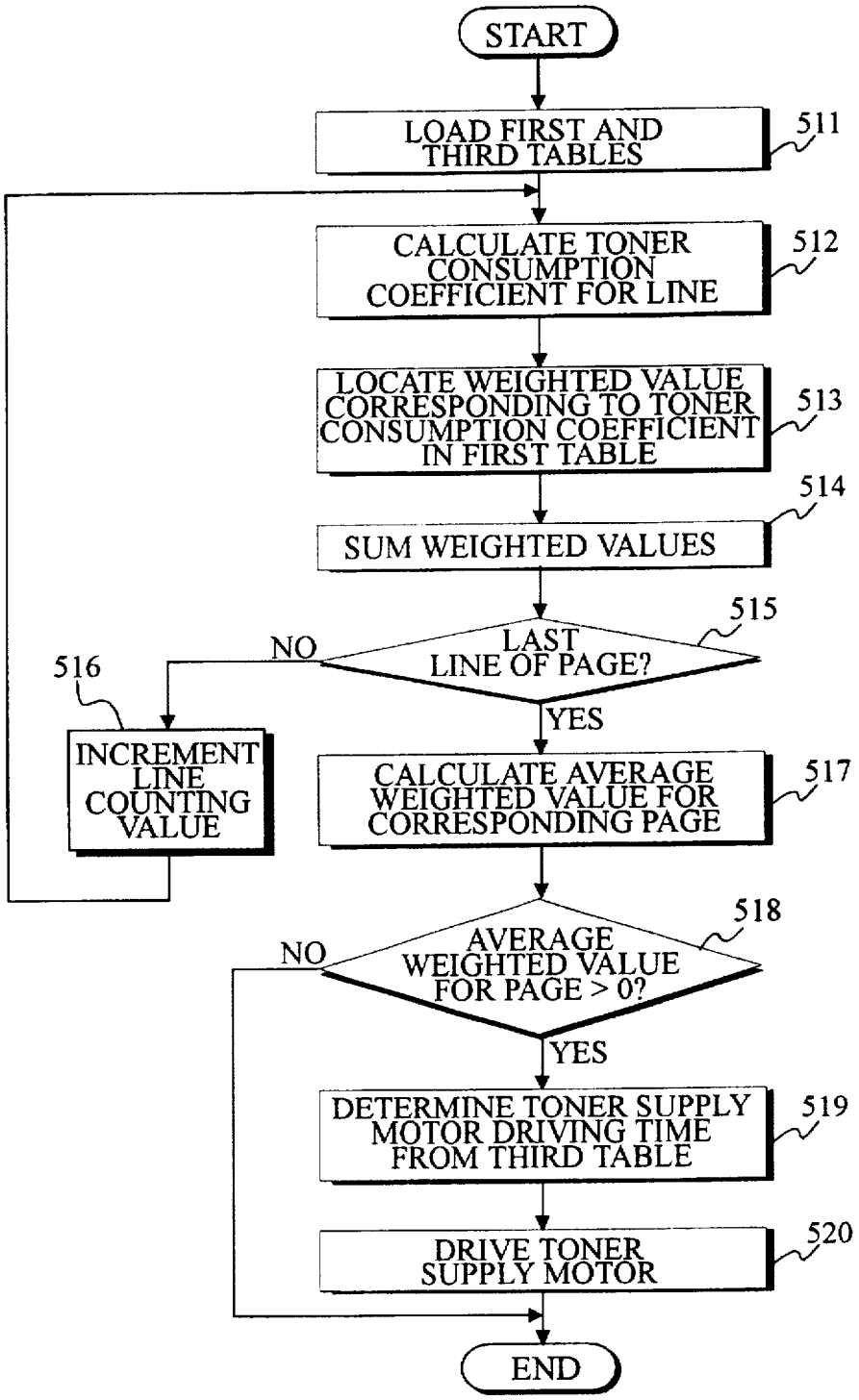
FIG. 5 is a flow chart showing a method for adjusting the toner density in an electrophotographic image recording apparatus according to the principles of the present invention.

Referring now to FIG. 5, the method for adjusting the toner density in an electrophotographic image recording apparatus according to the principles of the present invention will be described In step 511, CPU 160 loads the first and third tables. As indicated previously, Table 1 defines the relationship between the toner consumption coefficient and weighted value, and Table 3 defines the relationship between the weighted value and driving time of toner supply motor 190.

Thereafter, once the quantity of black image data of one line is received from counted data transmission section 130, CPU 160 calculates the toner consumption coefficient for a corresponding line in step 512. Here, the toner consumption coefficient is obtained from the following expression:

* toner consumption coefficient=(number of black data bits in one line)/(total number of data bits in one line)×100.

After calculating the toner consumption coefficient of the corresponding line, CPU 160 searches Table 1 to locate the weighted value corresponding to the toner consumption coefficient, in step 513. CPU 160 then sums the weighted values by adding the weighted value for the current line to the accumulated weighted values of the lines on the page processed up to that point, in step 514. In other words, an accumulative weighted value is obtained by summing the weighted values of the lines on the page processed up to that point. Then, CPU 160 analyzes the line counter in step 515 to determine whether the current line number is equal to the total number of lines on one page. That is, CPU 160 determines whether the current line is the last line of the page. If the value exhibited by the line counter is smaller than the number of lines on one page, the line counting value is incremented by one in step 516, and the method returns to step 512.

Accordingly, CPU 160 repeatedly performs steps 512 to 516 to obtain the toner consumption coefficients and corresponding weighted values for all of the lines on one page. Also during the repetition of these steps, the weighted values for the lines are summed to calculate an accumulative weighted value for the page. Once the last line of the page has been processed, CPU 160 proceeds to step 517 and calculates an average weighted value for the corresponding page. This is performed by dividing the accumulative weighted value for the page by the number of lines on the page. Next, CPU 160 determines whether the average weighted value is equal to zero, in step 518. At this time, if the average weighted value is equal to zero, the corresponding page is deemed to be a "white page" having no image data to be printed with toner. Therefore, toner supply motor driving section 180 is controlled to complete the method without driving toner supply motor 190. However, if the average weighted value is not equal to zero in step 518, there is image data to be printed with toner. Therefore, CPU 160 obtains the toner supply motor driving time corresponding to the average weighted value from Table 3, in step 519. CPU 160 then provides the toner supply motor driving time to toner supply motor driving section 180 to drive toner supply motor 190, in step 520.

Here, assuming that printing is performed at a speed of 6 pages per minute (PPM), the printing time for one page requires 12 seconds. The driving time of toner supply motor 190 is controlled to be uniformly distributed within the 12 second period in accordance with respective weighted values. For example, the driving time of toner supply motor 190 is 6 seconds in Table 3 when the average weighted value calculated from an arbitrary page is designated by "C." In this case, since toner supply motor 190 should be driven for 6 seconds in the 12 second period, the driving time has a duty ratio of 50% (i.e., on for 1.5 seconds and off for 1.5 seconds in the period of 3 seconds, and repeats four times).

Figure 6A:
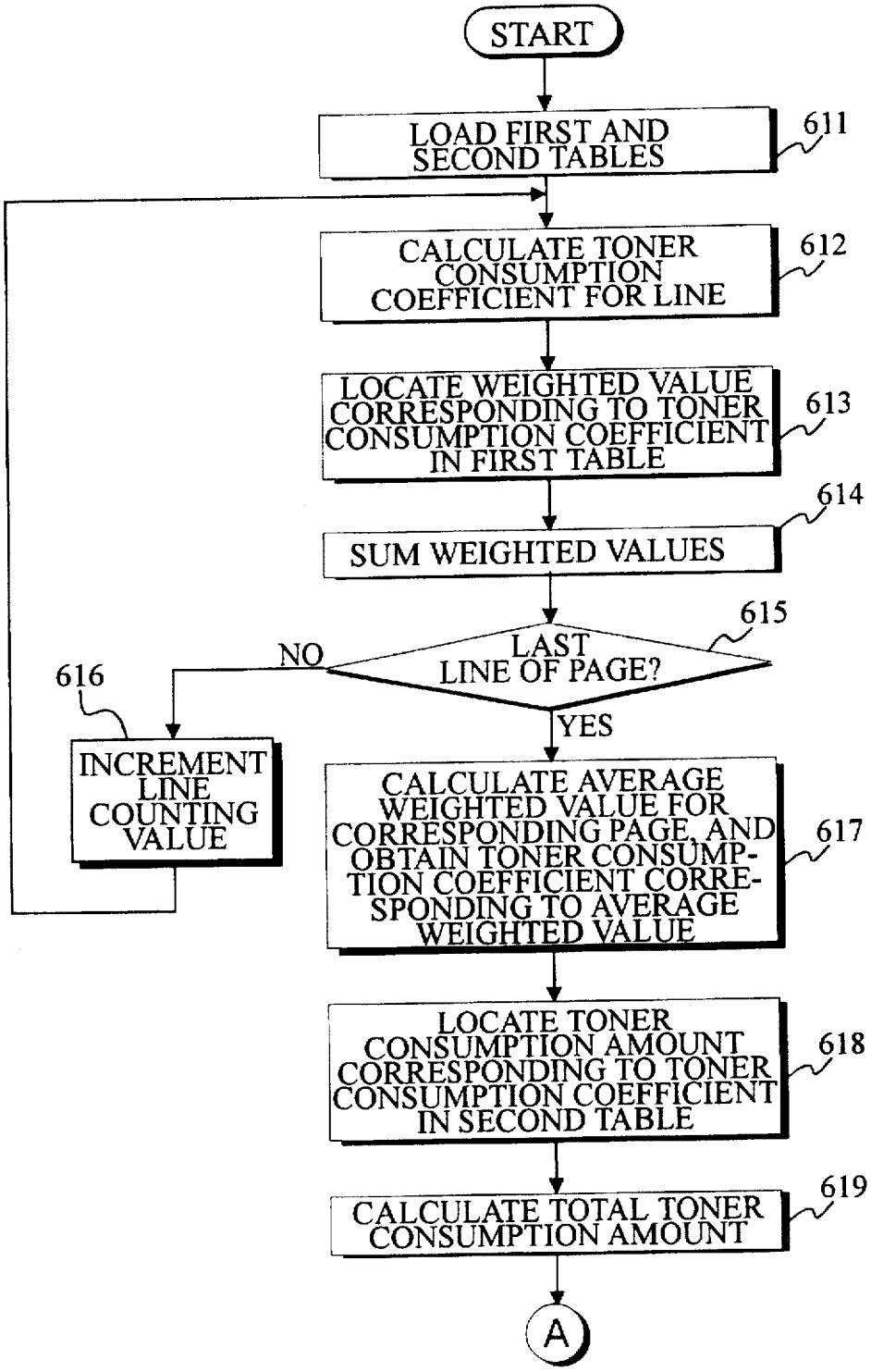
FIGS. 6A and 6B are flow charts showing a method for detecting toner consumption in an electrophotographic image recording apparatus according to the principles of the present invention.
Figure 6B:
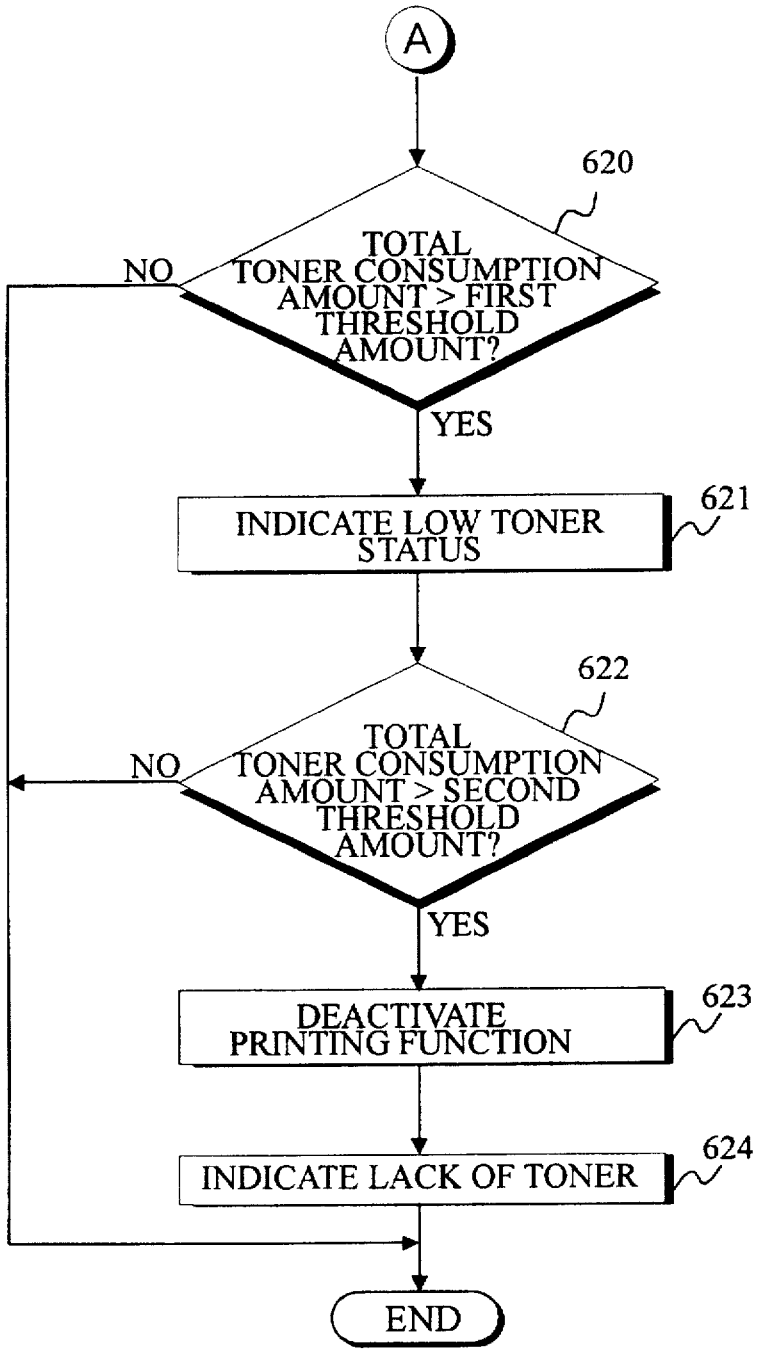

Moreover, the total amount of toner consumed can be managed. In other words, since the tables provide toner consumption coefficients and corresponding toner quantities, the total amount of toner consumed during a printing operation can be determined based on the number of pages being printed. In this case, the durable life of the image recording apparatus is managed by calculating the number of printed pages and the amount of toner used for each printed page. A method for detecting toner consumption according to the principles of the present invention will now be described with reference to FIGS. 6A and 6B.

In step 611, CPU 160 loads the first and second tables. As indicated previously, Table 1 defines the relationship between the toner consumption coefficient and weighted value, and Table 2 defines the relationship between the toner consumption coefficient and the amount of toner consumed, using one page as a reference.

Thereafter, once the quantity of black image data of one line is received from counted data transmission section 130, CPU 160 calculates the toner consumption coefficient for a corresponding line in step 612. Here, the toner consumption coefficient is obtained from the following expression:

* toner consumption coefficient=(number of black data bits in one line)/(total number of data bits in one line)×100.

After calculating the toner consumption coefficient of the corresponding line, CPU 160 searches Table 1 to locate the weighted value corresponding to the toner consumption coefficient, in step 613. CPU 160 then sums the weighted values by adding the weighted value for the current line to the accumulated weighted values of the lines on the page processed up to that point, in step 614. In other words, an accumulative weighted value is obtained by summing the weighted values of the lines on the page processed up to that point. Then, CPU 160 analyzes the line counter in step 615 to determine whether the current line number is equal to the total number of lines on one page. That is, CPU 160 determines whether the current line is the last line of the page. If the value exhibited by the line counter is smaller than the number of lines on one page, the line counting value is incremented by one in step 616, and the method returns to step 612.

Accordingly, CPU 160 repeatedly performs steps 612 to 616 to obtain the toner consumption coefficients and corresponding weighted values for all of the lines on one page. Also during the repetition of these steps, the weighted values for the lines are summed to calculate an accumulative weighted value for the page. Once the last line of the page has been processed, CPU 160 proceeds to step 617 and calculates an average weighted value for the corresponding page. This is performed by dividing the accumulative weighted value for the page by the number of lines on the page. The toner consumption coefficient corresponding to the average weighted value is then determined to complete step 617.

In step 618, CPU 160 locates the toner consumption amount corresponding to the toner consumption coefficient in Table 2. This toner consumption amount represents an average toner consumption amount. Then, in step 619, CPU 160 calculates the total toner consumption amount by adding the toner consumption amount for the current page to the accumulative toner consumption amount for the pages printed up to that point. That is, the total toner consumption amount represents the amount of toner to be consumed for the current page, plus the amount of toner that has been consumed up to that point since the toner supply cartridge was last replaced.

In the present invention, a first threshold amount and a second threshold amount are set for managing the supply of toner. Here, the first threshold amount is set to indicate when the toner supply becomes low. The second threshold amount is set to indicate when there is not enough toner remaining to properly perform the printing operation.

In step 620, CPU 160 determines whether the total toner consumption amount calculated in step 619 exceeds the first threshold amount. If the total toner consumption amount exceeds the first threshold amount, CPU 160 indicates a low toner status in step 621 by enabling a visual display and/or an audible tone. Alternatively, if the total toner consumption amount does not exceed the first threshold amount, the printing operation for the page can be performed.

After CPU 160 indicates the low toner status in step 621, CPU 160 advances to step 622 to determine whether the total toner consumption amount exceeds the second threshold amount. At this time, if the total toner consumption amount is between the first and second threshold amounts, CPU 160 merely indicates the toner-low status, and finishes the process for performing the printing operation. However, if the total toner consumption amount exceeds the second threshold amount, printing should not be performed until a new toner cartridge is provided. Accordingly, CPU 160 deactivates the printing function in step 623 by stopping the reception, copy and print functions (transmission function is maintained). That is, in the case of a facsimile, reception is refused by a line busy function when a terminating signal is generated. Then, CPU 160 indicates the lack of toner in step 624 by enabling a visual display and/or an audible tone.

The following example will be given to provide a better understanding of the present invention. Assuming that 1000 pages have been printed with a toner consumption coefficient of 5%, and 1000 pages have been printed with a toner consumption coefficient of 15%, the accumulative toner consumption amount is 1000*20 mg+1000*45 mg=65 g, by reference to Table 2. Further assume that 300 g of toner is present at the initial stage, 200 g is set as the first threshold amount and 280 g is set as the second threshold amount. Accordingly, when CPU 160 performs steps 612 to 618 for a current page, the toner consumption amount for the current page is added to the accumulative toner consumption amount of 65 g to generate the total toner consumption amount in step 619. Then, CPU 160 enables performance of the printing operation for the current page by recognizing that the total toner consumption amount is below 200 g and 280 g in steps 620 and 622, respectively. However, if after several additional pages are printed, the total toner consumption amount becomes greater than 200 g in step 620, the low toner status is visually and/or audibly indicated in step 621, thereby notifying the user that the toner cartridge should be replaced. When the total toner consumption amount ranges between 200 g and 280 g, a normal printing operation is enabled while the low toner status is indicated as described above. When the total toner consumption amount exceeds 280 g, however, CPU 160 de-activates the printing function in step 623, and indicates the lack of toner in step 624. As a result, the carrier phenomena brought by the toner consumption can be prevented to protect the image recording apparatus.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A method for adjusting toner density in an image recording apparatus storing a weighted value table for providing weighted values corresponding to toner consumption coefficients and a driving table for providing driving times of a toner supply motor corresponding to said weighted values, said method comprising the steps of:

calculating, for each line of a page, one of said toner consumption coefficients by dividing a number of black data bits represented on each said line by a total number of data bits represented on each said line;

obtaining from said weighted value table, said weighted values corresponding to said toner consumption coefficients calculated in said calculating step;

generating an average weighted value for said page representing an average of said weighted values obtained in said obtaining step;

locating from said driving table, one of said driving times corresponding to said average weighted value for said page; and driving said toner supply motor in accordance with said driving time located in said locating step to adjust the toner density while printing said page.

2. A method for adjusting toner density in an image recording apparatus storing a weighted value table for providing weighted values corresponding to toner consumption coefficients and a driving table for providing driving times of a toner supply motor corresponding to said weighted values, said method comprising the steps of:

calculating, for each line of a page, one of said toner consumption coefficients by dividing a number of black data bits represented on each said line by a total number of data bits represented on each said line;

obtaining from said weighted value table, said weighted values corresponding to said toner consumption coefficients calculated in said calculating step;

summing said weighted values obtained in said obtaining step to generate an accumulative weighted value;

dividing said accumulative weighted value by a number of lines of said page to generate an average weighted value for said page;

locating in said driving table, one of said driving times corresponding to said average weighted value; and driving said toner supply motor in accordance with said driving time located in said locating step to adjust the toner density.

3. The method as claimed in claim 2, wherein said driving time of said toner supply motor located in said locating step is uniformly distributed in accordance with said average weighted value for a print period of said page.

4. A method for detecting toner consumption in an image recording apparatus storing a weighted value table for providing weighted values corresponding to toner consumption coefficients and a toner consumption table for providing toner consumption amounts corresponding to said toner consumption coefficients, said method comprising the steps of:

calculating, for each line of a page, one of said toner consumption coefficients by dividing a number of black data bits represented on each said line by a total number of data bits represented on each said line;

obtaining from said weighted value table, said weighted values corresponding to said toner consumption coefficients calculated in said calculating step;

summing said weighted values obtained in said obtaining step to generate an accumulative weighted value;

dividing said accumulative weighted value by a number of lines of said page to generate an average weighted value for said page;

converting said average weighted value to a corresponding one of said toner consumption coefficients via said weighted value table;

locating in said toner consumption table, one of said toner consumption amounts corresponding to said corresponding one of said toner consumption coefficients;

computing a total toner consumption amount representing a quantity of toner expended from a toner supply source of said image recording apparatus since said toner supply source was installed;

comparing said total toner consumption amount with a first threshold amount, and printing said page when said total toner consumption amount is not greater than said first threshold amount;

comparing said total toner consumption amount with a second threshold amount greater than said first threshold amount, and printing said page when said total toner consumption amount is not greater than said second threshold amount;

printing said page while providing indication of a low toner status when said total toner consumption amount is greater than said first threshold amount and less than or equal to said second threshold amount; and de-activating said printing and providing indication of a lack of toner when said total toner consumption amount is greater than said second threshold amount.

5. The method as claimed in claim 4, wherein the indication of said low toner status is provided by a visual display.

6. The method as claimed in claim 5, wherein the indication of said low toner status is provided by an audible tone.

7. The method as claimed in claim 4, wherein the indication of said lack of toner is provided by a visual display.

8. The method as claimed in claim 7, wherein the indication of said lack of toner is provided by an audible tone.

9. An image recording apparatus, comprising:

toner supply means for supplying toner for a printing operation;

memory means for storing a weighted value table providing weighted values corresponding to toner consumption coefficients and a driving table providing driving times of said toner supply means corresponding to said weighted values; and control means for adjusting a density of said toner by:

calculating, for each line of a page, one of said toner consumption coefficients by dividing a number of black data bits represented on each said line by a total number of data bits represented on each said line;

obtaining from said weighted value table, said weighted values corresponding to said toner consumption coefficients calculated in said calculating step;

generating an average weighted value for said page representing an average of said weighted values obtained in said obtaining step;

locating from said driving table, one of said driving times corresponding to said average weighted value for said page; and driving said toner supply means in accordance with said driving time located in said locating step to adjust the density of said toner while printing said page.

10. A method for adjusting toner density in an image recording apparatus, comprising the steps of:

loading a weighted value table providing weighted values corresponding to toner consumption coefficients and a driving table providing driving times of a toner supply motor corresponding to said weighted values;

calculating, for each line of a page, one of said toner consumption coefficients by dividing a number of black data bits represented on each said line by a total number of data bits represented on each said line;

obtaining from said weighted value table, said weighted values corresponding to said toner consumption coefficients calculated in said calculating step;

generating an average weighted value for said page representing an average of said weighted values obtained in said obtaining step;

locating from said driving table, one of said driving times corresponding to said average weighted value for said page; and driving said toner supply motor in accordance with said driving time located in said locating step to adjust the toner density while printing said page.

11. A method for detecting toner consumption in an image recording apparatus, comprising the steps of:

loading a weighted value table providing weighted values corresponding to toner consumption coefficients and a toner consumption table providing toner consumption amounts corresponding to said toner consumption coefficients;

calculating, for each line of a page, one of said toner consumption coefficients by dividing a number of black data bits represented on each said line by a total number of data bits represented on each said line;

obtaining from said weighted value table, said weighted values corresponding to said toner consumption coefficients calculated in said calculating step;

summing said weighted values obtained in said obtaining step to generate an accumulative weighted value;

dividing said accumulative weighted value by a number of lines of said page to generate an average weighted value for said page;

converting said average weighted value to a corresponding one of said toner consumption coefficients via said weighted value table;

locating in said toner consumption table, one of said toner consumption amounts corresponding to said corresponding one of said toner consumption coefficients;

computing a total toner consumption amount representing a quantity of toner expended from a toner supply source of said image recording apparatus since said toner supply source was installed;

comparing said total toner consumption amount with a first threshold amount, and printing said page when said total toner consumption amount is not greater than said first threshold amount;

comparing said total toner consumption amount with a second threshold amount greater than said first threshold amount, and printing said page when said total toner consumption amount is not greater than said second threshold amount;

printing said page while providing indication of a low toner status when said total toner consumption amount is greater than said first threshold amount and less than or equal to said second threshold amount; and de-activating said printing and providing indication of a lack of toner when said total toner consumption amount is greater than said second threshold amount.

12. The method as claimed in claim 11, wherein the indication of said low toner status is provided by a visual display.

13. The method as claimed in claim 12, wherein the indication of said low toner status is provided by an audible tone.

14. The method as claimed in claim 11, wherein the indication of said lack of toner is provided by a visual display.

15. The method as claimed in claim 14, wherein the indication of said lack of toner is provided by an audible tone.

* * * * *